United States Patent [19]

Dubé

[11] Patent Number: 4,696,468

[45] Date of Patent: Sep. 29, 1987

[54] JUGGLING CLUB

[76] Inventor: Brian J. Dubé, 24 Washington Sq. N., New York, N.Y. 10011

[21] Appl. No.: 400,108

[22] Filed: Jul. 20, 1982

[51] Int. Cl.[4] ..... A63B 15/00

[52] U.S. Cl. ..... 272/124; 273/72 A; 273/82 A

[58] Field of Search ..... 272/124, 143; 273/82 R, 273/82 A, 72 A, 72 R, 80 A, 81 R, 193 A, 194 R

[56] References Cited

U.S. PATENT DOCUMENTS

| | | | |
|---|---|---|---|
| 629,626 | 7/1899 | Taylor | 272/124 |
| 1,122,137 | 12/1914 | Littlejohn | 272/124 |
| 1,491,279 | 4/1924 | Stewart | 273/82 A |
| 1,968,616 | 7/1934 | Oldham | 273/81 R |
| 3,971,837 | 7/1976 | Hasegawa et al. | 273/82 R X |
| 4,279,416 | 7/1981 | Finnigan, III | 272/124 |
| 4,323,239 | 4/1982 | Ishii | 273/72 A |

FOREIGN PATENT DOCUMENTS

| | | | |
|---|---|---|---|
| 253963 | 4/1961 | Australia | 273/82 R |
| 257959 | 12/1926 | United Kingdom | 272/124 |
| 446726 | 5/1936 | United Kingdom | 272/124 |

*Primary Examiner*—Richard J. Apley
*Assistant Examiner*—Robert W. Bahr
*Attorney, Agent, or Firm*—Melvin K. Silverman

[57] ABSTRACT

A juggling club is formed of a hollow, unitary molded plastic body having a bulged portion, a relatively heavy knob and handle portion, and a center of gravity located at between 55 and 59 percent of the length of the longitudinal axis toward the bulged end of the club. The thickness of the body wall of the club is substantially greater at the handle and knob portions than at the bulged portion.

7 Claims, 5 Drawing Figures

JUGGLING CLUB

BACKGROUND OF THE INVENTION

The present invention is concerned with a novel juggling club and, more particularly, a juggling club having a center of gravity more advantageiously disposed than centers of gravity of prior art juggling apparatus. In the prior art, the center of gravity is typically located well beyond the physical center of the club, i.e., in the neighborhood of 70% of the distance from the club handle to the opposite end of the club. The prior art design typically involves the use of a solid wood knob and handle which are secured into a hollow wooden center body. Given the considerable size and weight of the center body in the prior art design, the unavoidable result is a center of gravity located well past the longitudinal center of the club.

Other prior art approaches involve the use of a hollow unitary plastic body having a uniform wall thickness.

These prior art designs also suffer from certain inherent physical and, thusly, aerodynamic instability due primarily to the fact of the considerable displacement of the center of gravity from the center of the longitudinal axis of the club. Such instability manifests itself in many ways, these including difficulty in control of the club by jugglers, wobbling of the club during rotation, and excessive and unnecessary speed of rotation of the club. Further, the undesirable location of the center of gravity in prior art clubs creates a much greater velocity of rotation at the knob end of the club than at the flared end of the club. This, of course, increases the difficulty of controlling and catching clubs of prior art design.

An additional shortcoming of prior clubs is that the use of wood as a material causes the overall weight of the club to be greater than necessary for most juggling needs. This enhanced weight is yet another factor which has made life more difficult for the juggling community.

The prior art with reference to juggling clubs has for the most part been placed in U.S. Class 272, Subclass 124, with some art having been placed in U.S. Class 273, Subclass 96R.

SUMMARY OF THE INVENTION

The present invention is a juggling club comprising a hollow, unitary, molded plastic body in the configuration of a kingpin. The width of the body wall of the juggling club is greatest at the knob end and is least at the flared end thereof, the juggling club having a center of gravity located at about 57% of the length of the longitudinal axis of the club and occurring somewhat before the occurrence of the bulge of the kingpin. The width of the body wall is adapted in order to result in a placement of the center of gravity at the desired location. The novel juggling club is preferrably molded out of a polyethelene plastic.

It is an object of the present invention to provide an improved juggling club composed of a sturdy, hollow, unitary molded body having a center of gravity that will result in a club which may be more easily controlled and safely handled than those of the prior art.

It is a further object of the present invention to provide a club which may be more easily and economically manufactured.

It is still a further object to provide a club which can be more readily used by amateur jugglers and students.

It is a yet further object to provide a club which is more durable than prior art juggling clubs.

The above and other objects and advantages of the instant invention will be evident from the following detailed description when read in conjunction with the accompanying drawings which illustrate the preferred embodiment of the invention.

DETAILED DESCRIPTION OF THE INVENTION

Figure 1:
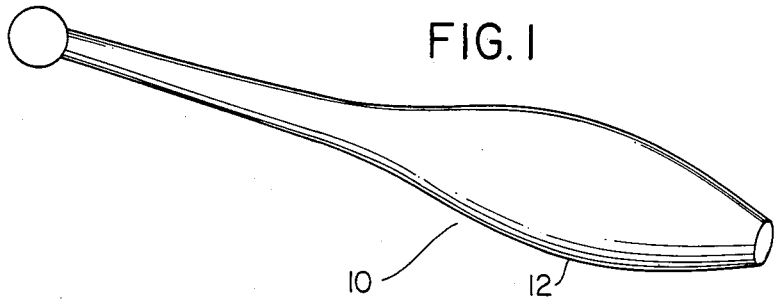
FIG. 1 is a perspective view of the present novel juggling club.

The generalized configuration of the present juggling club 10 is shown in FIG. 1. In said figure it is to be appreciated that the bulge 12 of the club is located somewhat closer to the center 14 of the plane of the longitudinal axis than is typical in clubs of prior art design.

Figure 2:
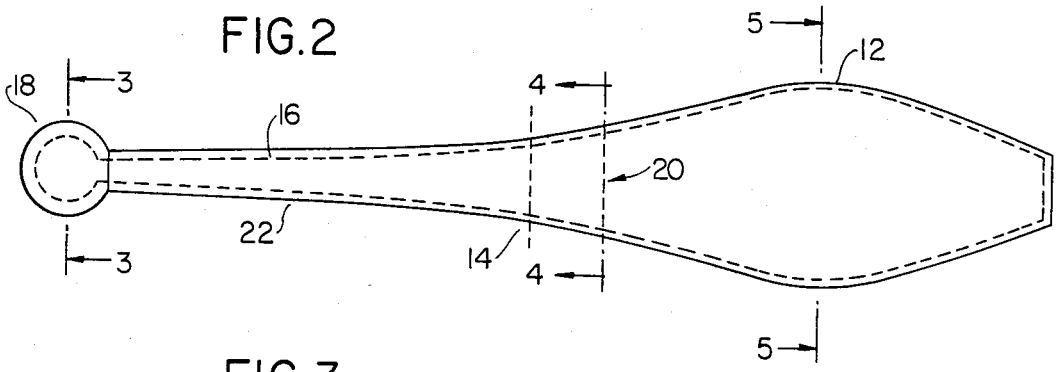
FIG. 2 is a longitudinal cross-sectional view of the club in which the interior dimensions of the body wall are shown in phantom.
Figure 3:
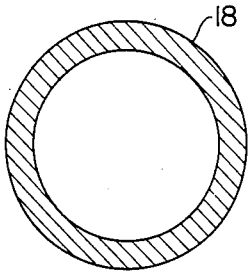
FIG. 3 is a cross-sectional radial view taken from line 3—3 of FIG. 2 and through the center of the knob of the club.
Figure 4:
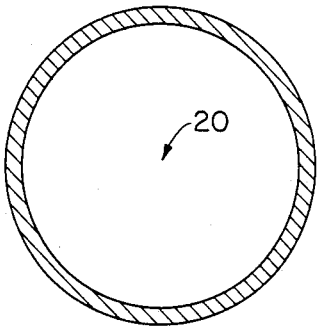
FIG. 4 is a cross-sectional radial view taken along line 4—4 of FIG. 2 and along the plane of the center of gravity of the club.
Figure 5:
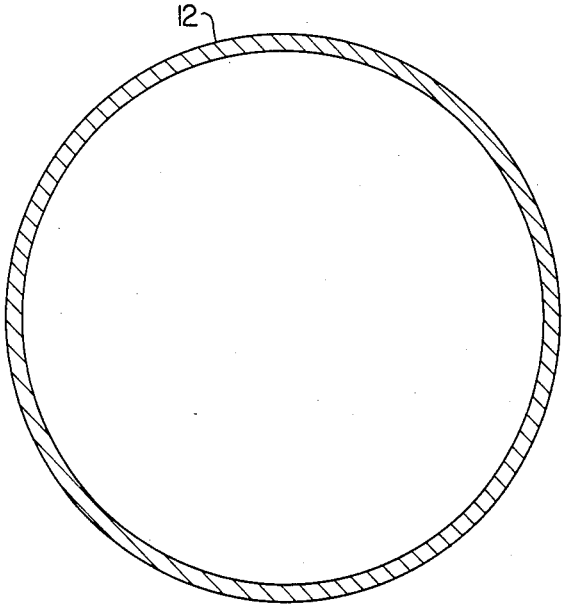
FIG. 5 is a cross-sectional radial view taken along line 5—5 of FIG. 2 along the plane of greatest dimension of the bulge of the club.

In FIG. 2 is shown the club in longitudinal cross-section with the interior dimension of the body wall 16 shown in phantom. In this view, the unitary molded plastic construction of the body may be noted. Such construction is accomplished by a technique known as rotational molding. The material of choice has been found to be polyethelene, although other plastics may be suitable to the present application. The overall weight of the illustrated club is in the range of eight to nine ounces, this representing a considerable reduction in weight as against clubs of prior art structure. From FIG. 2, as well as the radial cross-sectional views of FIGS. 3, 4 and 5, it is noted that the thickness of the body wall 16 increases substantially at the knob end 18 of the club (FIG. 3). In particular, the preferred thickness of the body wall at the cross-section of FIG. 5 (the bulge) is about 110 thousandths of an inch, while the preferred thickness at the cross-section of FIG. 3 (the knob) is about 180 thousandths of an inch. The thickness at the plane of the center of gravity 20 (FIG. 4) is about 125 thousandths. It has been determined that by increasing the width of the body wall at the handle 22 and knob 18, the center of gravity 20 can be brought closer to the physical center 14 of the club. Accordingly, by bringing the center of gravity closer to the physical center of the club, a more stable rotation is obtained, and the difference in linear velocity between the respective ends of the club is reduced as against prior art designs. These features all contribute to an ease of usage and greater effectiveness in such usage by the juggler. Also, such clubs are safer for use by students and amateurs.

In the preferred embodiment, the length of the juggling club is about 21 inches while the center of gravity exists about $11\frac{7}{8}$ inches along the longitudinal axis from the end of the knob 18. This cite of the center of gravity is between 56 and 57 percent along the length of the longitudinal axis from the knob of the club; such positioning of the center of gravity has been found to be optimal for club construction and use; however, the range of 55 to 59 percent has been found to be acceptable.

The outside diameter of the club is, in the preferred embodiment, 1 9/16 inches at the knob, 1½ inches at the center of gravity, and 3⅝ inches at the greatest dimension of the bulge 12. Thus, the ratio of the outside diameter of the bulged portion to that of the knob is about 2.3. Also, the outside diameter of the bulged portion to the mean outside diameter of the handle portion is about 3.6.

With further reference to the dimensions of the body wall, the optimum ratio of knob thickness to minimum thickness (occurring beyond the bulge) has been found to be about 1.9, while the optimum ratio of thickness of the body wall of the knob to such thickness at the center of gravity has been found to be about 1.44.

It is to be appreciated that any change in the length of the club would require corresponding and proportionate changes in the width of the body wall as well as in other dimensions discussed above. It has also been found that a club of the present polyethelene, unitary construction possesses certain properties of resilience not present in prior designs. As such, it is possible for a juggler to more readily maintain control of a club after it has fallen to the floor or stage.

The present design may, where desired, be provided with fanciful external decorations as is customary in the juggling field.

While there has been shown and described the preferred embodiment of the present invention, it will be understood that the invention may be embodied otherwise than is herein specifically illustrated or described and that within said embodiment certain changes in the detail and construction, and the form and arrangement to the parts, may be made without departing from the underlying idea or principle of this invention within the scope of the appended claims.

Having thus described my invention, what I claim as new, useful and non-obvious and, accordingly, secure by Letters Patent of the United States is:

1. A juggling club, comprising: a hollow, unitary, molded plastic body substantially in the configuration of a kingpin in which one end of said club includes a bulged portion and the opposite end thereof includes a knob portion, said bulged portion and said knob portion being integrally connected by an elongated handle portion, where the thickness of the body wall of said juggling club gradually increases from the bulged end to the knob end wherein such thickness results in the center of gravity of the club being located at between 55 and 59 percent of the longitudinal length of the club from the knob end of the club toward the bulged end so as to bring the center of gravity in close proximity to the physical center of the club, further wherein the ratio of the greatest width of the body wall to the least width of the body width is about 1.9.

2. The juggling club as recited in claim 1 in which the center of gravity thereof is disposed at about 57% of the length of the longitudinal axis from the knob end of the club and toward the bulged portion thereof.

3. The club as recited in claim 1 in which the body thereof is rotationally molded and is formed of a polyethelene material.

4. The juggling club as recited in claim 1 or 2 in which said club comprises an overall length of about 21 inches, and a total weight of about 8 ounces.

5. The juggling club as recited in claim 1 or 2 in which the ratio of the external diameter of the bulged portion to that of the mean diameter of the handle portion is approximately 3.6.

6. The juggling club as recited in claim 1 or 2 in which the ratio of the wall thickness at the knob portion of the club to the wall thickness at the bulge portion is approximately 1.65.

7. The juggling club as recited in claim 1 or 3 in which the ratio of the mean wall thickness of the handle to that at the bulge is about 1.33.

* * * * *